US010830229B1

(12) United States Patent
Lurker

(10) Patent No.: US 10,830,229 B1
(45) Date of Patent: Nov. 10, 2020

(54) PORTABLE INFLATABLE APPARATUS

(71) Applicant: Joseph D. Lurker, Lake Forest, CA (US)

(72) Inventor: Joseph D. Lurker, Lake Forest, CA (US)

( * ) Notice: Subject to any disclaimer, the term of this patent is extended or adjusted under 35 U.S.C. 154(b) by 0 days.

(21) Appl. No.: 16/408,392

(22) Filed: May 9, 2019

(51) Int. Cl.

| | |
|---|---|
| ***F04B 49/22*** | (2006.01) |
| ***F04B 49/02*** | (2006.01) |
| ***F04B 35/04*** | (2006.01) |
| ***F04B 39/10*** | (2006.01) |
| ***F04B 53/10*** | (2006.01) |
| ***F04B 49/08*** | (2006.01) |
| *G09F 15/00* | (2006.01) |

(52) U.S. Cl.
CPC ..... *F04B 49/022* (2013.01); *F04B 35/04* (2013.01); *F04B 39/10* (2013.01); *F04B 49/08* (2013.01); *F04B 49/225* (2013.01); *F04B 53/109* (2013.01); *F04B 2207/02* (2013.01); *F04B 2207/042* (2013.01); *G09F 15/0025* (2013.01)

(58) Field of Classification Search
CPC ..... G09F 15/0025; A63G 31/12; A63H 3/06
USPC ..... 40/412, 610; 446/179, 220, 223, 226; 472/134
See application file for complete search history.

(56) References Cited

U.S. PATENT DOCUMENTS

| | | | | |
|---|---|---|---|---|
| 4,005,537 | A * | 2/1977 | von Camber | E01F 13/02 40/610 |
| 4,330,119 | A | 5/1982 | Marshall, Jr. | |
| 4,837,958 | A * | 6/1989 | Radovich | G09F 1/08 248/237 |
| 5,125,177 | A * | 6/1992 | Colting | G09F 15/00 40/538 |
| 5,330,403 | A | 7/1994 | Kuo | |
| 5,335,906 | A | 8/1994 | Delker | |
| 5,566,935 | A | 10/1996 | Meharg | |
| 5,961,426 | A | 10/1999 | Spector | |
| 6,148,551 | A * | 11/2000 | Glass | G09F 21/08 40/214 |
| 6,347,470 | B1 | 2/2002 | Radovich | |
| 6,644,843 | B2 | 11/2003 | Chin-Cheng | |
| 6,764,201 | B2 | 7/2004 | Chi-Cheng | |
| 6,804,905 | B1 * | 10/2004 | Burger, III | G09F 15/0025 40/212 |

(Continued)

*Primary Examiner* — Joanne Silbermann
(74) *Attorney, Agent, or Firm* — Buchalter, A Professional Corp; Sean Casey

(57) ABSTRACT

A portable inflatable apparatus that includes a rigid polymeric base having an exterior circumference, which extends between top and bottom walls that together with the exterior define an interior compartment accessible via a circumferential panel and a top wall opening. A battery powered air pump is mounted in the interior compartment, and an inflatable structure is releasably retained about the top wall and has a deflated stowage volume that is less than a portion of the compartment. The apparatus is formed with a shape that when inflated projects away from the base when pressurized. A valve couples the pump with the inflatable structure, and is configured to manually and/or automatically retain and release pressure within the structure. The apparatus may also incorporate control and access panels, a pressure sensor for automated inflation and deflation, a cover to retain the stowed inflatable structure, a power supply and/or charging port, and lighting.

18 Claims, 6 Drawing Sheets

(56) References Cited

U.S. PATENT DOCUMENTS 7,197,841 B2 4/2007 Hsu
7,302,769 B2 * 12/2007 Machala ..... G09F 15/0025 40/610
7,302,771 B2 12/2007 Hsu
7,614,171 B2 11/2009 Hsu
7,758,400 B2 7/2010 Moomaw
8,800,186 B2 * 8/2014 Zhang ..... G09F 19/02 40/610
8,814,729 B2 8/2014 Hartigan
2001/0002354 A1 5/2001 Gazit et al.
2003/0013375 A1 1/2003 Austin
2003/0128553 A1 * 7/2003 Chin-Cheng ..... A63H 3/06 362/257
2005/0252055 A1 11/2005 Pellecuer et al.
2006/0025037 A1 * 2/2006 Lau ..... G09F 15/0025 446/226
2006/0150451 A1 * 7/2006 Spielberger ..... G09F 15/0025 40/412
2006/0286892 A1 12/2006 Moomaw
2007/0022642 A1 2/2007 Hsu
2007/0094907 A1 * 5/2007 Scarberry ..... G09F 15/0025 40/610
2007/0117658 A1 5/2007 Best et al.
2007/0141947 A1 7/2007 Chin-Cheng
2007/0207881 A1 9/2007 Ross et al.
2008/0233831 A1 * 9/2008 Hsu ..... F04D 27/00 446/220
2008/0260299 A1 10/2008 Ng
2009/0149281 A1 6/2009 Johnson
2010/0175330 A1 7/2010 Turcot
2012/0328801 A1 12/2012 Horn
2014/0155181 A1 6/2014 Zhang
2014/0255648 A1 * 9/2014 Meek ..... E01F 9/681 428/137
2014/0290104 A1 * 10/2014 Lindblom ..... G09F 15/0025 40/559
2015/0321061 A1 11/2015 Begando et al.
2016/0042667 A1 2/2016 Kusafuka
2016/0129333 A1 5/2016 Kroeten
2017/0072328 A1 * 3/2017 Sze ..... A63H 3/06
2017/0321688 A1 * 11/2017 Shao ..... F04B 49/08

* cited by examiner

FIG. 7
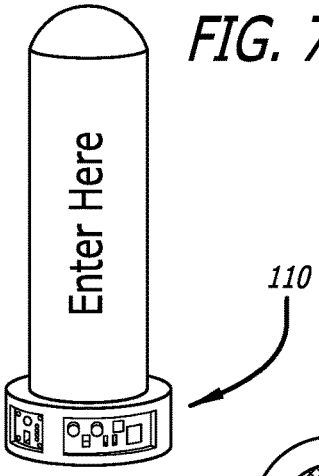
FIG. 8
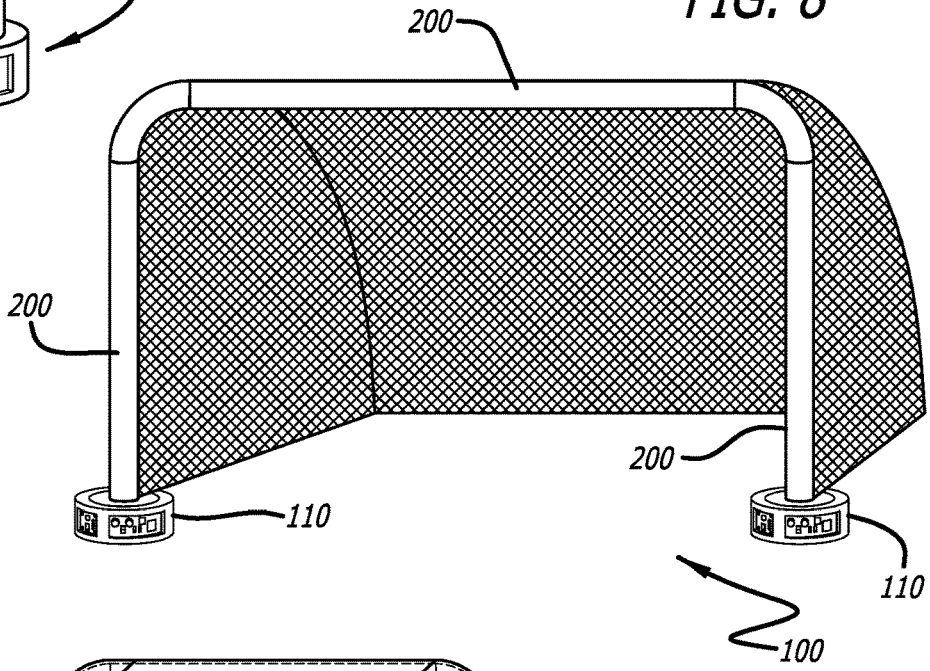
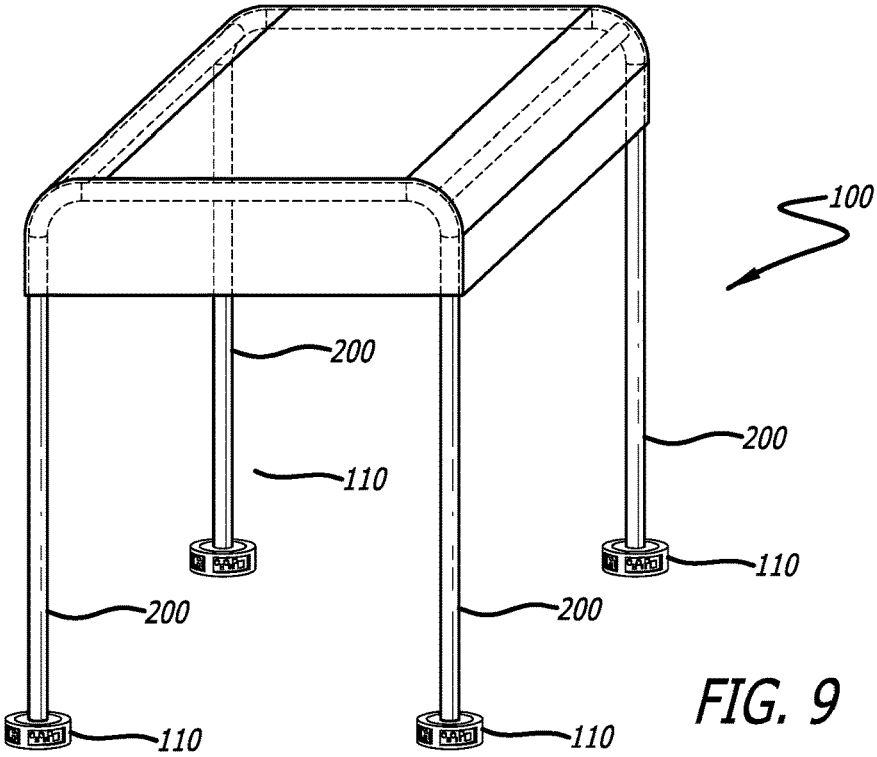
FIG. 9

PORTABLE INFLATABLE APPARATUS

TECHNICAL FIELD

The disclosure relates to a portable and inflatable apparatus configured for use in various indoor and outdoor configurations including for example advertising, recreation, and sports training applications where inflatable structures, monuments, and manikins can be utilized.

BACKGROUND

Manufacturers of various types of inflatable structures, monuments, and manikins have attempted to implement devices and apparatuses that can be installed and removed for various sports, recreational, and other applications. Despite many years of development, such devices remain difficult to use, remove, move, and refurbish, and a long-felt need remains for a portable inflatable device or apparatus that is easy to design, set-up, configure, remove, store, transport, and refurbish.

SUMMARY

Some attempts have been made to improve prior devices, but none have contemplated a new and improved portable inflatable apparatus that includes a rigid base, which has an exterior circumference extending between top and bottom walls, which together define an interior compartment accessible via one or more openings formed in the base, including for example, one or more of a removable, exterior-facing or external surface and top and/or bottom wall openings. The improved apparatus also incorporates a battery powered air pump that is mounted in the interior compartment.

An inflatable structure, monument, and/or manikin/mannequin (hereafter also referred to collectively as "inflatable structure(s)") is also included and is releasably retained proximate to, on, and/or about the top wall or another part of the apparatus. The inflatable structure or structures is/are also formed and configured to have a deflated stowage volume that is less than a portion of the compartment, so that it can be stowed within the portion of the interior compartment. The inflatable structure also is formed with and configured to have a shape that during pressurization and inflation that enables the structure to inflate and project away and/or outward from the base.

Variations of the portable inflatable structure incorporate one or more valves that are connected to and/or in communication with the pump and the inflatable structure, and which are configured to release and retain pressure within the inflatable structure. The one or more valves can be automatic and/or automated with electrically or pressure actuated solenoids, and can also instead or in combination, be manually actuatable, to further enable inflation and deflation of the inflatable structure(s), monument(s), and/or manikin(s).

In modifications, the portable inflatable apparatus may also include a pressure sensor that is coupled to and/or in fluid communication with the air pump and an interior of the inflatable structure, and which is configured to detect predetermined inflation and deflation pressures. Responsive to the sensor, one or more of or at least one of the air pump and valve are actuatable to automatically pressurize the inflatable structure(s) until the inflation pressure is detected, and to similarly depressurize the structure until the deflation pressure is detected. These modifications may also include the air pump being further configured to automatically reinflate the inflatable structure when an interior inflatable structure pressure is detected which is below the predetermined inflation pressure.

Other arrangements of the portable inflatable apparatus include at least one cover configured to close the top wall opening to thereby retain the deflated structure when stowed within the interior compartment. The at least one cover may also be configured in other ways to also isolate the interior compartment from an external environment. Additional variations may also include the inflatable structure being further formed to have one or more or a plurality tethers that are configured to releasably mount the inflatable structure(s) to tether points on the rigid base to be anchored thereto. Together with the shape and dimensions of the structure(s), this arrangement enables projection away and/or outwardly from the base during inflation, so that the structure(s) is/are upwardly free standing when the base rests against a ground surface.

The portable inflatable apparatus of the disclosure also contemplates incorporating a manually actuatable pressurization valve, which may be an additional valve or which may be formed as one of the various other valves contemplated and/or described herein. The manually actuatable valve is coupled to and/or in fluid communication with an interior volume of the inflatable structure, and is configured to manually open and close to retain and release pressure within and from the interior volume.

Still other modifications of the various arrangements of the disclosure also contemplate the portable inflatable apparatus including a plurality of controls that are mounted about a panel that is in turn mounted about, within, and/or to cover an opening of the at least one openings, and which controls are configured to actuate at least one of the components of the apparatus, including for example without limitation, the air pump and/or the valve(s), to inflate and deflate the inflatable structure(s). A battery may also be mounted in the interior compartment and be coupled to the air pump. The at least one openings may further mount and/or be covered by respective removable covers and/or panels that are configured to enable access to and/or replacement of one or more of the air pump, battery, inflatable structure, and other components of the apparatus of the disclosure.

The portable inflatable apparatus further contemplates arrangements that include at least one power port that is coupled to the battery, and which is configured to supply power from and to charge the battery, and which may be mounted about the base and/or one or more panels mounted about the opening(s) formed in the base. One or more lights may also be incorporated proximate the top wall of the base, which are positioned, selected, and/or configured to emit annunciation alerts and to illuminate the inflatable structure when inflated, among other capabilities. In variations, the one or more lights may instead be incorporated with, integral to, and/or mounted about the inflatable structure, and may be configured to be releasably coupled to the battery to illuminate the inflatable structure when attached to the base.

This summary of the implementations and configurations of the materials and described elements, components, and constituents introduces a selection of exemplary implementations, configurations, and arrangements, in a simplified and less technically detailed arrangement, and such are further described in more detail below in the detailed description in connection with the accompanying illustrations and drawings, and the claims that follow.

This summary is not intended to identify key features or essential features of the claimed technology, and it is not intended to be used as an aid in determining the scope of the claimed subject matter. The features, functions, capabilities, and advantages discussed here may be achieved independently in various example implementations or may be combined in yet other example arrangements, as further described elsewhere herein, and which may also be understood by those skilled and knowledgeable in the relevant fields of technology, with reference to the following description and drawings.

BRIEF DESCRIPTION OF THE DRAWINGS

A more complete understanding of example implementations of the present disclosure may be derived by referring to the detailed description and claims when considered with the following figures, wherein like reference numbers refer to similar or identical elements throughout the figures. The figures and annotations thereon are provided to facilitate understanding of the disclosure without limiting the breadth, scope, scale, or applicability of the disclosure. The drawings are not necessarily made to scale.

FIGS. 7, 8, and 9 show modifications of the portable inflatable structure of the preceding figures, with various structure and components added and removed for additional illustration purposes.

DETAILED DESCRIPTION

As required, detailed embodiments of the present invention are disclosed herein; however, it is to be understood that the disclosed embodiments are merely exemplary of the invention that may be embodied in various and alternative forms. As noted elsewhere, the figures are not necessarily to scale, and some features may be exaggerated or minimized to show details of particular components. Therefore, specific structural and functional details disclosed herein are not to be interpreted as limiting, but merely as a representative basis for teaching one skilled in the art to variously employ the features and elements of the disclosure.

As those of ordinary skill in the art should understand, various features, components, and processes illustrated and described with reference to any one of the figures may be combined with features, components, and processes illustrated in one or more other figures to enable embodiments that should be apparent to those of ordinary skill in the art, but which may not be explicitly illustrated or described. The combinations of features illustrated are representative embodiments for typical applications. Various combinations and modifications of the features consistent with the teachings of this disclosure, however, could be desired for particular applications or implementations, and should be readily within the knowledge, skill, and ability of those working in the relevant fields of technology.

Figure 1:
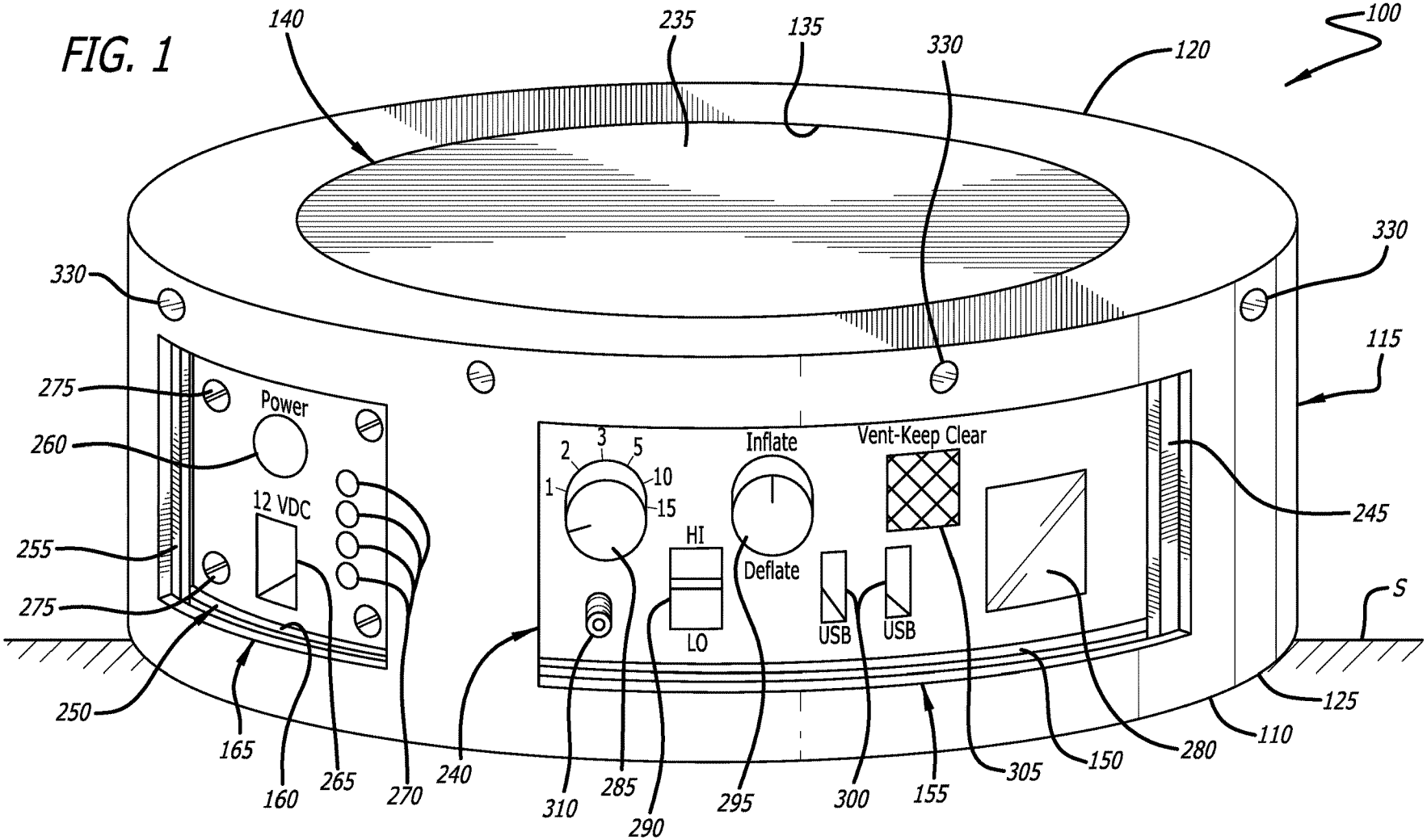
FIG. 1 is an illustration of a portable inflatable apparatus and its constituents, elements, components, and arrangements.
Figure 2:
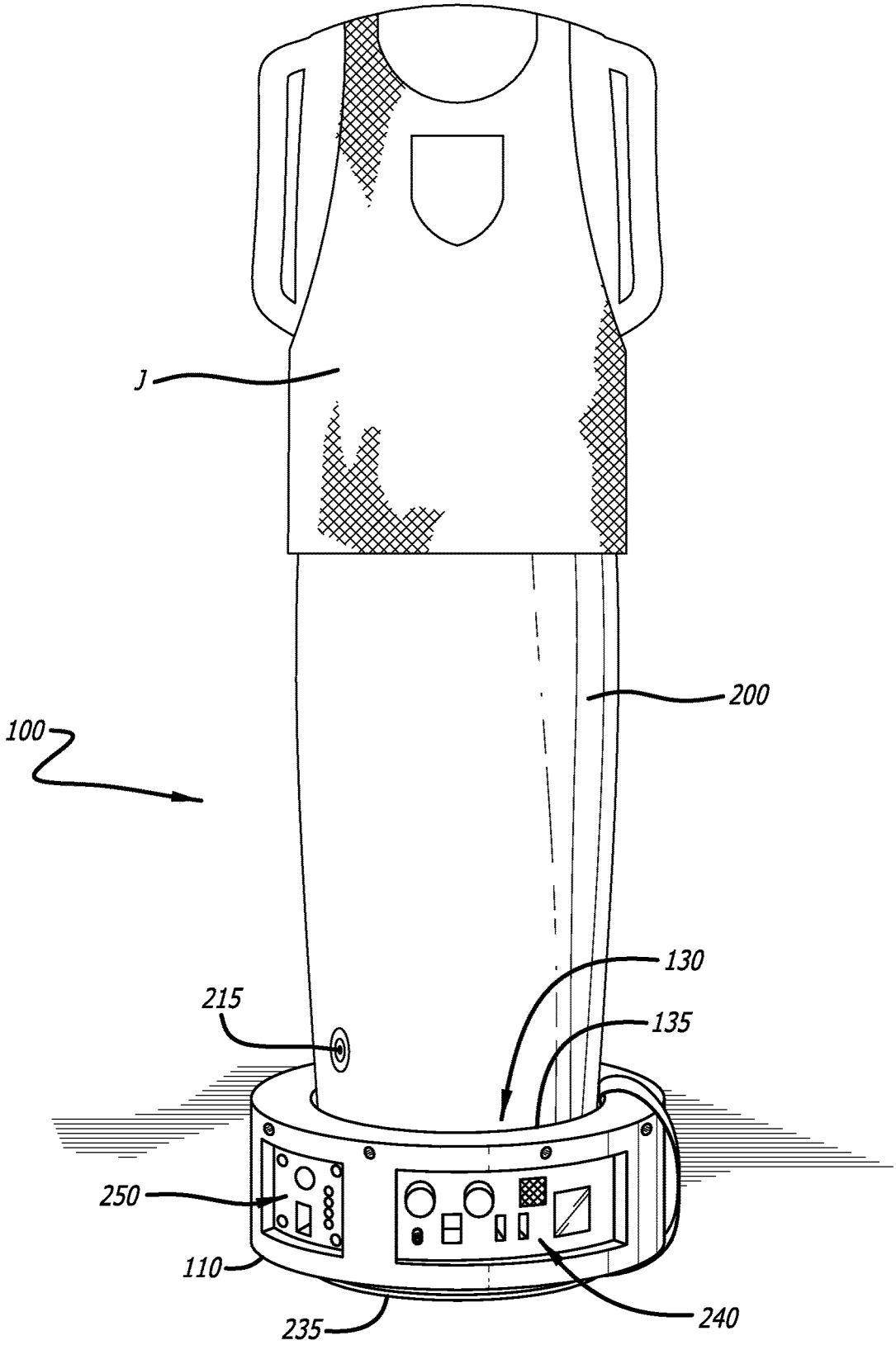
FIG. 2 illustrates certain aspects of the disclosure depicted in FIG. 1, with components removed and rearranged for purposes of illustration, and an inflated structure.

With reference now to the various figures and illustrations and specifically to FIGS. 1 and 2, a schematic diagram of a portable inflatable apparatus 100 is shown. The apparatus 100 includes a rigid polymeric base 110, which is depicted in FIGS. 1 and 2 resting on a surface S. In one variation, the base 110 may be formed to have a round, vehicular wheel or tire-shaped configuration having top and bottom walls with central, circular interior edges that define openings into an interior volume. In other adaptations, the base 110 may be formed in any shape, and from a molded polymeric and/or elastomeric material that is selected to be moisture resistant and/or water proof, resistant to deterioration from exposure outdoor contaminants and environments, and resilient, rigid, and to have a preferred density, weight, shape, and dimensions.

In further examples, the base 110 may be formed from a natural or synthetic elastomeric rubber material similar to that used for vehicle tires, but may also be formed from many other polymeric materials including for example, neoprene, nitrile, silicone, ethylene propylene diene monomer rubber or EPDM, styrene-butane rubber or SBR, santoprene, and other thermoplastic and thermoset materials. In these various arrangements, the base 110 is selected to have a firm to rigid hardness depending upon the preferred application. For purposes of this disclosure, a Shore durometer and related hardness scales are referred to and utilized herein to establish a preferred hardness, firmness, or rigidity of the base 110 for various applications. A Shore durometer is a tool that measures the hardness of rubbers, polymers, elastomers, and other polymeric materials.

Many types of durometer test equipment are available from a variety of suppliers, and include for example, Hoto-Instruments of Northbrook, Ill., USA (hoto-instruments.com). Various industry standards are available for establishing durometer hardnesses and tolerances, and include for example and among others, ASTM D785-08 (2015), entitled "Standard Test Method for Rockwell Hardness of Plastics and Electrical Insulating Materials," and ASTM D2240-15, entitled "Standard Test Method for Rubber Property-Durometer Hardness." A person having skill in the relevant field of technology should be able to understand that such materials are typically measured on one or two Shore durometer scales: an "A" scale (used for material hardness depression testing) or a "D" scale (material puncture testing). Use of the A scale has been found to be appropriate for purposes of this disclosure.

For sports applications of the portable inflatable apparatus 100, such as football and soccer, a firm or rigid base 110 is preferred and will have a Shore durometer hardness of approximately that of a vehicle tire or roller skate wheel, which varies between about Shore 50 to about 100 hardness on the durometer "A" scale, or more or less. The Shore scale hardness is selected to enable the base 110 to deflect and rebound a particular sports game piece, such as a football or soccer ball, such that the base 110 can receive, deflect, and rebound ball impacts in ways similar to a player kick or a goalpost rebound of the ball. For sports such as hockey wherein a puck is used that is harder than a soccer ball, it may be preferred that base 110 be more rigid and have a Shore hardness of about 100 A or more. In other non-sports related applications of apparatus 100, such as for inflatable sign-post or decorative monuments, tent or canopy posts, and others, the hardness of base 110 may be less of a factor such that other materials may be suitable for fabricating the base 110.

Figure 4:
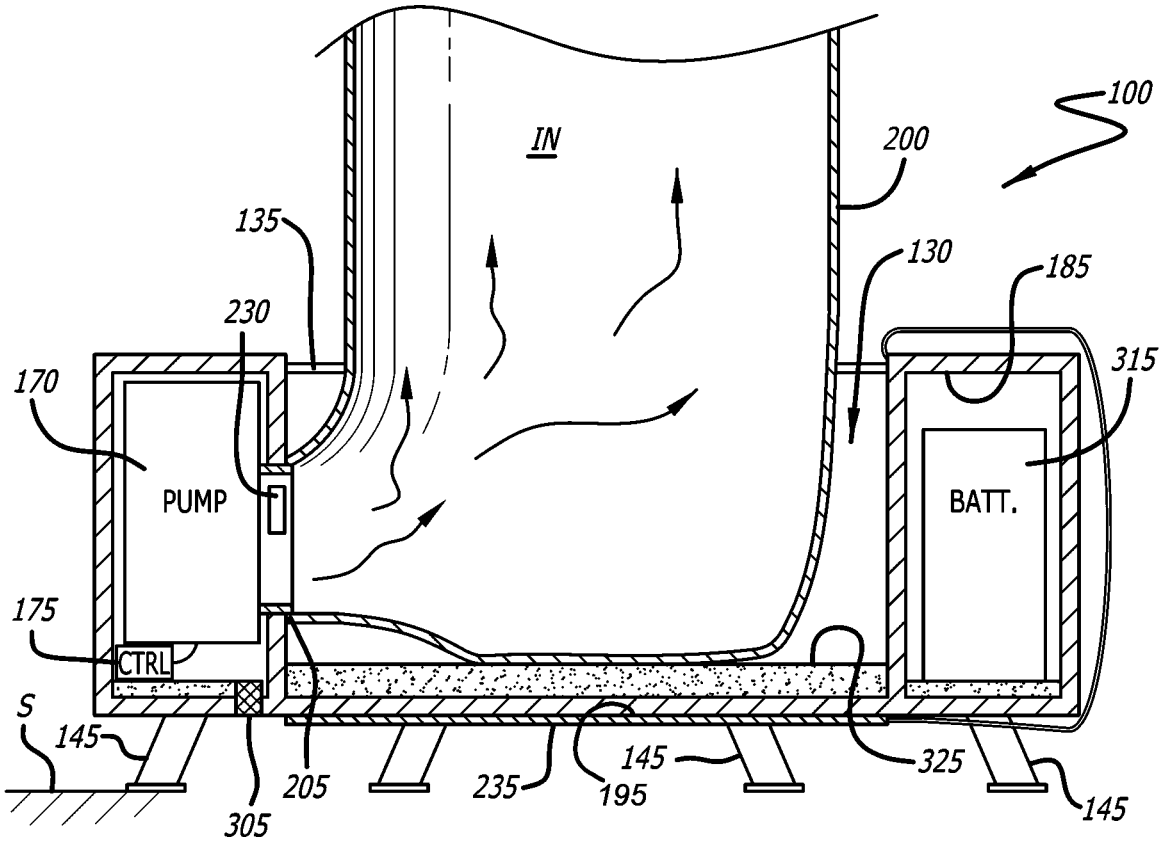
FIG. 4 describes a cross-section view of the portable inflatable structure of the preceding figures, with various structure removed and added for illustration purposes, and a partial view of an inflated structure.
Figure 5:
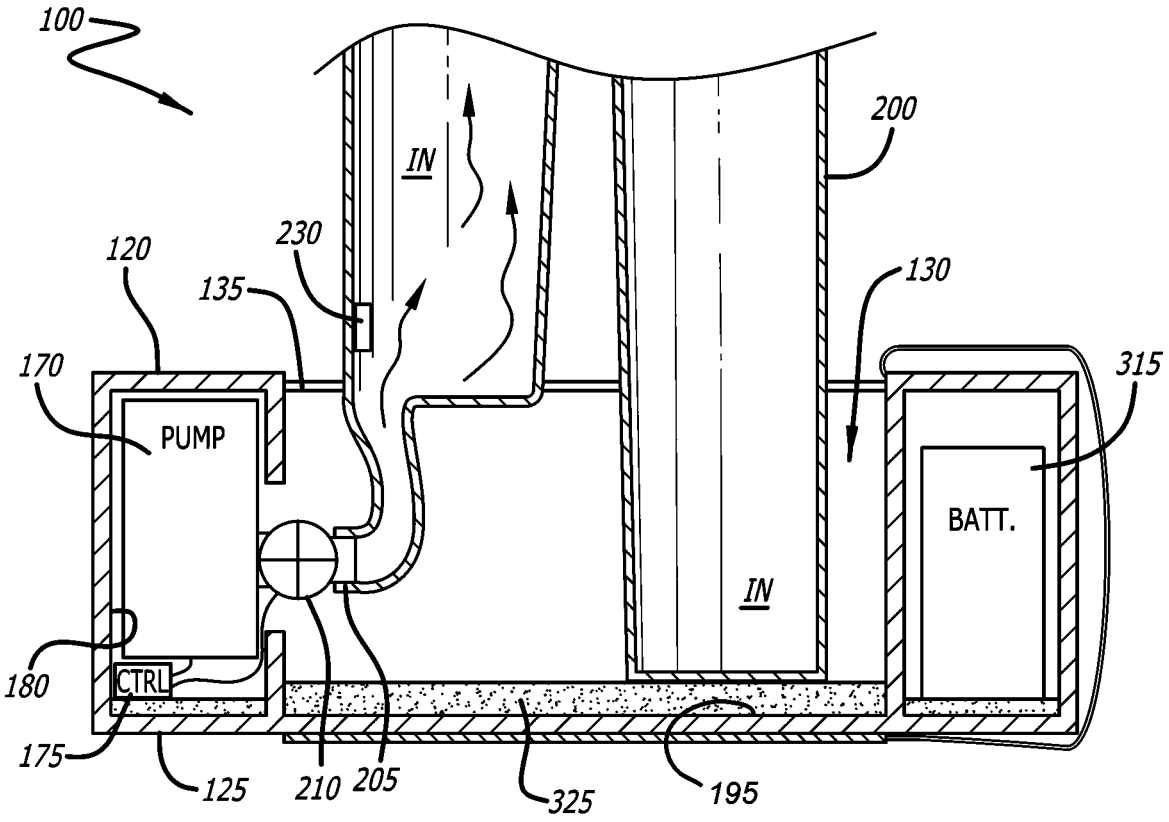
FIG. 5 illustrates a cross-section view of the portable inflatable structure of the preceding figures, with various structure and components added and removed for further illustration purposes.

The base 110 of the disclosure also includes an exterior circumference or surface 115 that extends between a top wall 120 and a bottom wall 125, which together define an interior compartment 130 (FIGS. 2, 4, 5). The interior compartment 130 is accessible through at least one opening formed in and/or defined by elements of the base 110. For example, top wall 120 may be formed with an interior circumferential edge 135, which defines an opening 140, and bottom wall 125 may incorporate similar features. Bottom wall may also include a plurality of stand-off stanchions or feet 145 (FIG. 4) that enable base 110 to rest against a surface such as a ground surface without full contact, which can minimize or prevent exposure to moisture, grass, dirt, and other contaminants. In other alternative configurations, exterior circumference or surface 115 may include first cut-out 150, which defines first opening 155, second cut-out 160 defining second opening 165, and others.

In some of the contemplated applications, the base 110 has been found to be effective when fabricated from a material having about a 70 A durometer hardness or so (for example, +/−about 10% to about 20%), a weight of between about six and about 20 pounds or more or less, a height between about four and about 10 inches between top and bottom walls 120, 125 or more or less, and a diameter of between about 12 and about 24 inches or more or less. Larger weights and dimensions may be preferred to support larger inflatable structures, while smaller weights and dimensions may be preferable for other structures and applications. In other variations, for further examples without limitation, base 110 is configured for use in soccer or football sporting applications to have a weight of between about 15 and about 20 pounds, a height of between about five and about six inches, and a diameter of between about 12 and about 14 inches. Additionally preferred weights and dimensions are contemplated for many of these and other additional applications.

Figure 3:
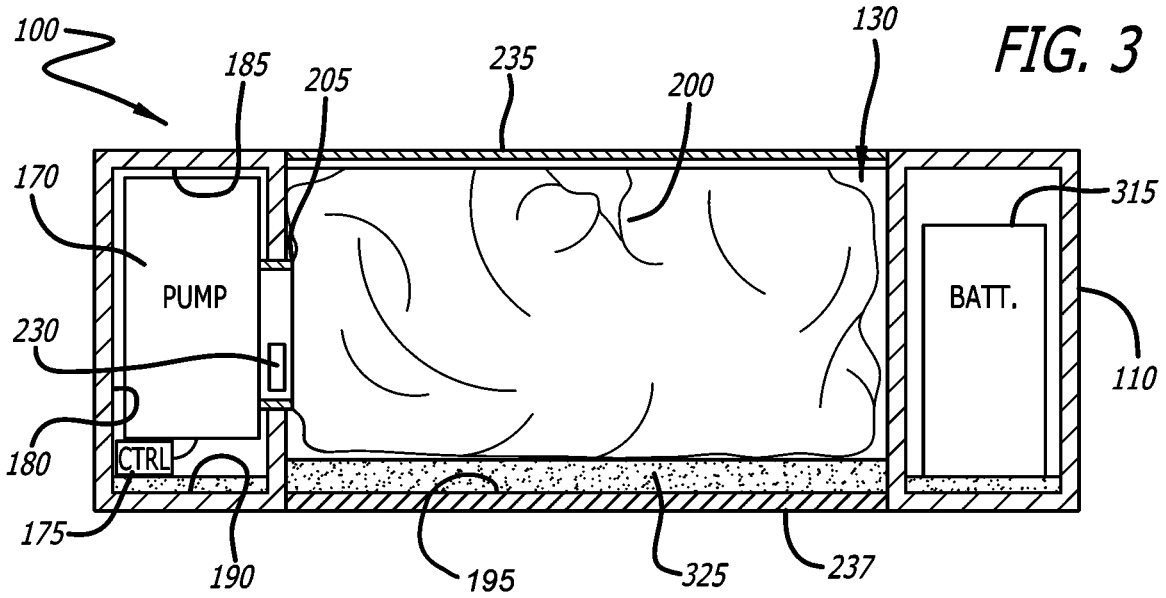
FIG. 3 depicts a cross-section view of the portable inflatable structure of the preceding figures, with various structure removed and added for illustration purposes, and a deflated structure stowed within an interior compartment.

With continuing reference to FIGS. 1 and 2 and now also to FIGS. 3, 4, and 5, portable inflatable apparatus 100 is depicted to also include a battery powered air pump 170 and control electronics 175 that may be separately or integrally fabricated as part of pump 170, and which are mounted in the interior compartment 130 about an interior surface or circumference 180, and between respective interior sides 185, 190 of top and bottom walls 120, 125. Air pump 170 may incorporate and/or be coupled to one or more automatic or manual actuatable valves 210 and/or reversible valves 210 to enable pump 170 to operate as both a pump and as a valve to enable reversible, low pressure, high volume inflation and deflation of structure(s) 200 and/or external devices.

Air pump 170 is selected preferably to enable high volume inflation/deflation air flow of between about 0.5 and about five cubic feet per minute, and a low inflation pressure that ranges between about three to about 15 pounds per square inch gauge pressure ("psig"), or more or less. Gauge pressure is conventionally defined herein to measure and/or establish pressure supplied by air pump 170 relative to ambient or average sea-level, standard, 70 degree Fahrenheit, atmospheric pressure of 14.7 psi ("psia"), which is also defined here to be zero psig. Therefore, if air pump 170 supplies a pressure of five psig to an inflatable structure 200 or external item, it is intended herein to mean that the inflatable structure(s) 200 is/are to be pressurized to 5 psig (above atmospheric pressure), for a total internal inflatable structure pressure of about 19.7 psia. Many manufacturers supply reversible inflation/deflation pumps with incorporated actuatable valves and control electronics that are suitable applications contemplated for air pump 170, and include for example without limitation, air pumps available from National Ventures Sevylor of Huntington Beach, Calif., US, Nixy Sports of Irvine, Calif., US, Etekcity Corporation of Anaheim, Calif., US, and many others.

Apparatus 100 also incorporates one or more inflatable structures, monuments, and/or manikins 200 as depicted in FIGS. 2 through 8, which may be formed from at least one polymeric and/or elastomeric material, such as a PVC—polyvinylchloride, PE—polyethylene, and/or other flexible, resilient material, that is configured to be airtight and inflatable when attached to apparatus 100, and to be moisture resistant and/or water-proof, and resistant to deterioration from exposure to outdoor contaminants and environments. As depicted in the various figures, the one or more inflatable structures, monuments, and/or manikins 200 may include low fidelity manikins (FIGS. 2, 4) and higher fidelity manikins (FIGS. 5, 6), which can be configured to don jerseys J or other indicia of a team or sponsoring entity. The one or more inflatable structures, monuments, and/or manikins 200 may also be shaped, formed, and dimensioned for other applications, such as a sign post, monument, or decorative object (FIG. 7), a football/soccer, rugby, or hockey field sport net, a canopy or tent (FIG. 9), and other such inflatable structures, monuments, and/or manikins 200

The inflatable structure(s) 200 also incorporate at least one inflation port 205 configured to be releasably coupled to air pump 170 either directly or with an automatic or manual, actuatable valve or valves 210, as depicted schematically in FIG. 5. The releasable coupling of port 205 enables quick and easy removal, replacement, cleaning, and refurbishment of structure(s) 200. A manual inflation and deflation valve 215 (FIGS. 2, 6) may also be incorporated about inflatable structure(s) 200. Either or all of port 205 and valves 210, 215 are and/or may be configured to be in communication with air pump 170 and inflatable structure(s) 200, and are also configured to inflate, deflate, and releasably retain pressure within the inflatable structure(s) 200.

As reflected in FIG. 3, inflatable structure(s) 200 are also dimensioned, sized, and shaped to have a deflated stowage volume that is less than a portion of the interior compartment 130. As depicted in FIG. 3, deflated structure(s) 200 is shown stowed in part within a portion of interior compartment 130 that is positioned centrally within base 110. It is also contemplated that other portions of interior compartment 130 may be similarly utilized for stowage of the deflated structure(s) 200, including for example portions of interior compartment 130 not utilized by other components of apparatus 100, such as air pump 170, a battery, control electronics, valves, and other components. As a person of ordinary skill in the relevant technology should be able to understand, inflatable structure(s) 200 are also configured and formed to have a shape that, during inflation and when inflated or pressurized, enables structures(s) 200 to project and inflate away and outwardly and/or upwardly from base 110, as depicted in FIGS. 2, 4, 5, 6, 7, and 8.

In additional variations of the disclosure, inflatable structure(s) 200 are also releasably retained to and/or anchored by base 110, about top wall 120. In one exemplary arrangement, port 205 is connected to air pump 170 (FIG. 3, 4) to enable retention and anchoring. In other exemplary arrangements, structure(s) 200 are retained and anchored to base 110 with port 205 coupled to valve 210. With reference also to FIG. 5, structure(s) 200 incorporate and/or attach to and are anchored and/or retained to base 110 by one or more tethers 220, which are configured to releasably attach to one or more corresponding tether points 225 mounted or formed on top wall 120 or another position on base 110.

The portable inflatable apparatus 100 of the disclosure also contemplates modifications that incorporate one or more pressure sensors 230 that are in fluid communication with air pump 170 and an interior "IN" of inflatable structure(s) 200. Pressure sensor(s) 230 may be mechanically and/or electrically operated and in electrical and/or wireless communication with air pump 170 and/or other control electronics of apparatus 100, and are configured to detect one or more predetermined inflation and deflation pressures.

Sensor(s) 230 may be mechanically operated electrical pressure switches, and may also be micromechanical and other types of transducer-based sensors, and may include low-power wireless communications capabilities, such as Bluetooth®, near field communication (NFC), and others, to reduce or eliminate the need to electrically connect sensor(s) 230 with wiring to control electronics of apparatus 100. Such pressures can be predetermined to establish a maximum inflation pressure of structure(s) 200, relative to an external atmospheric pressure. Such pressures also contemplate a minimum deflation pressure of structure(s) 200, which may be a vacuum relative or gauge pressure establishing that structure(s) 200 is/are deflated and ready for stowage.

Also contemplated by the disclosure are adaptations of portable inflatable apparatus 100 that incorporate at least one and/or one or more of air pump 170, inflation port 205, valve(s) 210, sensor(s) 230, and/or other control electronics, which are configured to automatically actuate one or more of air pump 170, port 205, and/or valve(s) 210 to pressurize structure(s) 200 until the inflation pressure is detected, and to reversibly deflate or depressurize structure(s) 200 until the deflation pressure is detected. The disclosure contemplates such configurations of apparatus 100 are adapted to inflate structure(s) 200 to the predetermined inflation pressure between about 0.5 psig and about 5 psig, or so, and are configured to automatically reinflate inflatable structure(s) 200 when an interior pressure is detected that is below the predetermined inflation pressure. Users of apparatus 100 may also override and manually operate the various control electronics to inflate and deflate structure(s) 200 and external devices without use of such automated features, which automated features may not be included in some adaptations.

The air pump 170 of the disclosure may also be modified to incorporate inflation/deflation ports adapted to be coupled to external inflatable items and/or extension hoses further configured to inflate one or more such external items, including for example balls used for American football, international football/American soccer, volleyball, basketball, and the like. These external items require inflation pressures ranging between about 4.3 psig (volleyballs) and higher for basketballs (about 8.5 psig), American footballs (about 13 psig), and American soccer or international footballs (about 8.5 psig to about 15.6 psig).

In further modified arrangements of the portable inflatable apparatus 100, at least one cover 235, which may be attached to base 110 by a cover tether (FIGS. 2, 4). Cover 235 is configured to close one of the at least one openings, such as the top wall opening 140, and to retain the deflated structure(s) 200 within interior compartment 130 (FIG. 3). In this arrangement, the at least one cover 235 is configured to snap into and/or attach to edge 135 to isolate the interior compartment 130 from an external environment (FIG. 1), and to be stowed beneath base 110 when removed (FIGS. 2, 4). In other arrangements of the disclosure, a flexible bag or other container that is sized to receive portable inflatable apparatus 100 may be utilized (not shown) in place of and/or in combination with cover 235 to retain inflatable structure(s) 200, and to protect, transport, and store apparatus 100. A similarly configured bottom cover 237 (FIG. 3) may also be included in some exemplary configurations, wherein an opening is also formed in bottom wall 125.

Figure 6:
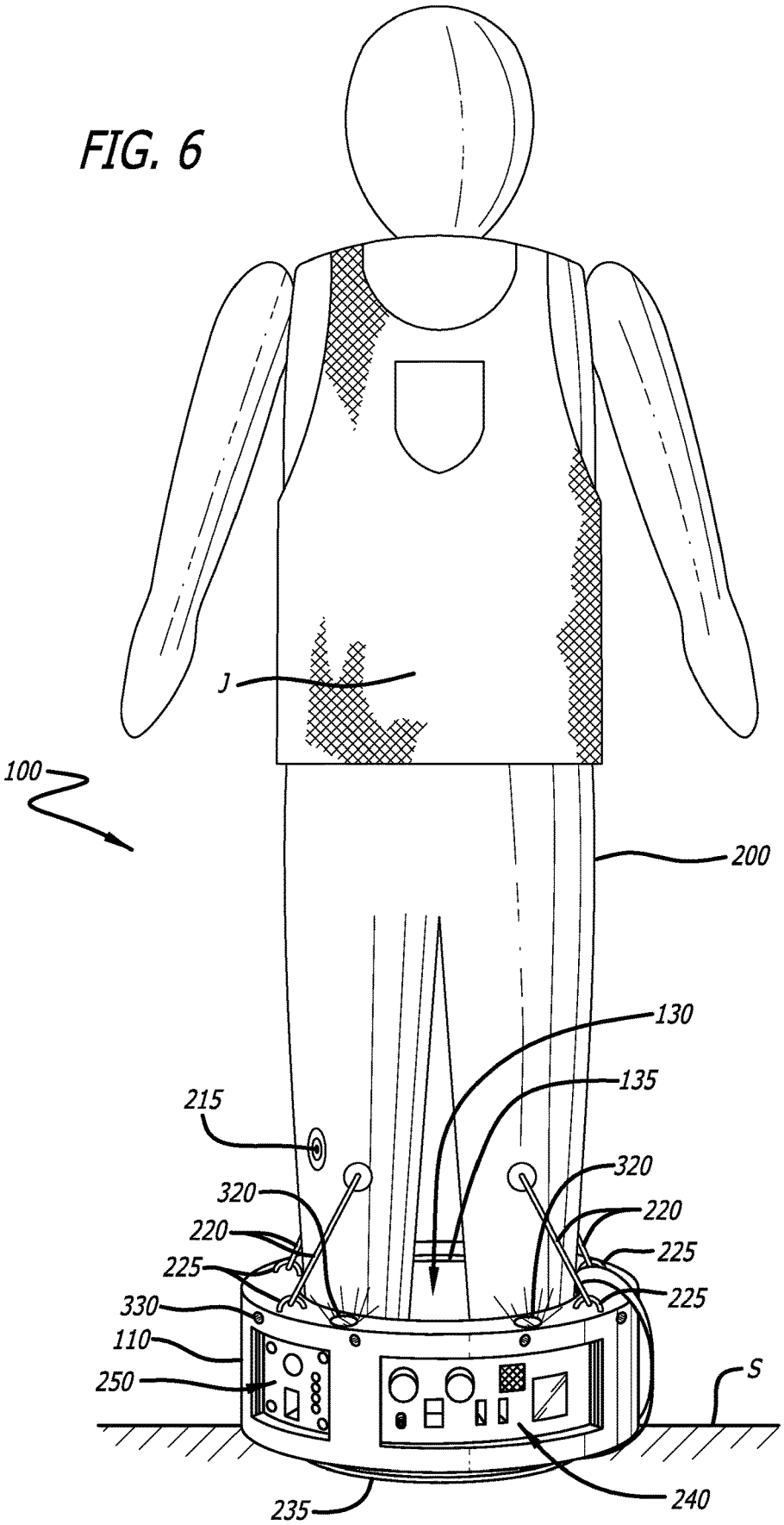
FIG. 6 depicts another variation of the portable inflatable structure of the preceding figures, with additional structure and components shown for purposes of further examples.

With specific continued reference to FIGS. 1, 2, and 6, among others, portable inflatable apparatus 100 also may include a plurality of controls that can be mounted anywhere about base 110. For example but not for purposes of limitation, a control panel 240 may be mounted about first opening 155 and may also incorporate a slidable or otherwise closable control panel cover 245. Further examples contemplate a power panel 250 that is mounted with and/or adjacent to panel 240, and/or about a second opening 165 and including a closable power panel cover 255. The plurality of controls may include, for additional example, a power on/off switch 260 to activate apparatus 100, a battery charging/power supply port 265 (e.g., 6/12 volts direct current or VDC), and/or battery charge state indicator lights 270, and panel release fasteners 275 that enable removal of panel 250 and access to interior compartment 130 for removal and replacement of components. Panel 240 may similarly include fasteners 275 for removability.

Further examples of controls of the plurality may include others mounted on exemplary control panel 240 and other panels or positions on base 110, which can include a status display or screen 280 configured to display data for battery charge, pressures detected by sensor(s) 230, and other data. Also contemplated are a pressure setting or selector control 285, a high/low pressure selector (HI/LO) 290, a pump reverse/inflate/deflate switch 295, one or more universal serial bus (USB) power supply/data communication ports 300, an inflation/deflation vent port 305, and an external item inflation/deflation port 310 that is configured to couple to an extension hose, a ball inflation needle, and/or other external devices. For alternative configurations of apparatus 100 that include a plurality of stand-off stanchions or feet 145, vent port 305 may also be incorporated about bottom wall 125 proximate to air pump 170 as depicted in FIG. 4.

In further variations according to the disclosure, portable inflatable apparatus 100 also includes at least one battery 315, which may be mounted within interior compartment 130, and electrically coupled to air pump 170 and control electronics of control and power panels 240, 250 (FIGS. 3, 4, 5). Battery 315 may be coupled to power port 265, USB ports 300, and other control electronics to supply power from and to charge battery 315. One or more of top cover 235, bottom cover 237, and panels 240, 250 are adapted whereby at least one of openings 140, 155, 165, and other openings are configured to enable replacement of one or more of air pump 170, battery 315, inflatable structure 200, and other components of apparatus 100.

In further variations of the disclosure, portable inflatable apparatus 100 also may include one or more lights 320, which may be mounted upon, into, and/or incorporated proximate to top wall 120 and about other surfaces of base 110, and in positions that are configured to illuminate inflatable structure(s) 200 and/or to annunciate alerts to nearby individuals. Lights 320 may also be mounted about structure(s) 200 for additional illumination and annunciation alert applications. The lights 320 may be automatically actuated control electronics in low light environments, by automated light annunciation controls in response to detected proximity of nearby individuals, and/or by one or more switches mounted near or on lights 320, base 110, and/or panels 240, 250.

The disclosure also contemplates modifications of apparatus 100 that include various center of gravity ("CG") enhancements, which can for example include bottom wall 125 being formed with an thickness that is larger relative to top wall 120, and which may also further include alone or in combination a CG plate 325 (FIGS. 3, 4, 5) that is positioned and/or affixed about interior side 195 of bottom wall 125. The apparatus 100 may also further incorporate a plurality of imaging, audio, and proximity sensors and devices 330 (FIG. 1), which are configured to enable capture of video and audio, to broadcast audio and annunciation alerts, and to detect motion and proximity of nearby individuals during use and operation. Data captured by control electronics and/or devices 330 and other components may be communicated externally via USB ports 300 and/or wirelessly to external devices.

The sensors and devices 330 also may control lights 320 to annunciate alerts in response to detected motion and proximity of individuals moving within a predetermined distance of apparatus 100. In further arrangements of the disclosure, apparatus 100 may include multiple bases 110 as shown in FIGS. 7, 8, and 9, to enable applications such as a portable inflatable sign-post apparatus or monument 100 as shown in FIG. 7, a football/soccer, rugby, and/or hockey net or structure as reflected in FIG. 8 that includes at least two bases 110, and/or tent/canopy applications having additional bases 110 as shown in FIG. 9.

While exemplary embodiments are described above, it is not intended that these embodiments describe all possible forms of the disclosure of apparatus 100. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A portable inflatable apparatus, comprising:

a rigid polymeric base configured to have a weight of between 15 and 20 pounds and to rest on a ground surface and having a diameter of between about 12 and 24 inches defined by an exterior round circumference extending between about four and ten inches between top and bottom walls defining an interior compartment accessible via at least one opening formed in the exterior circumference, the exterior round circumference formed to be resilient with a hardness between about Shore A 50 and 100 and to extend vertically up from the bottom wall around the entire base to have a thickness sized relative to the vertical extent to, in combination with the weight, deflect responsive to impacts of a sports game piece, to rebound the sports game piece;

a battery powered air pump mounted in the interior compartment;

the base including at least one center of gravity enhancement as part of the weight and selected from at least one of (a) the bottom wall formed with thickness that is larger than that of the top wall, and (b) a center of gravity plate positioned about an interior side of the bottom wall;

an inflatable structure releasably retained about the base and formed with deflated stowage volume less than a portion of the compartment, and a shape configured to project away from the base when pressurized; and a valve in communication with the pump and inflatable structure, configured to releasably retain pressure within the structure.

2. The portable inflatable apparatus according to claim 1, comprising:

a pressure sensor, in fluid communication with the air pump and an interior of the inflatable structure, configured to detect predetermined inflation and deflation pressures; and at least one of the air pump and valve actuatable to automatically: (a) pressurize the structure until the inflation pressure is detected, and (b) depressurize the structure until the deflation pressure is detected.

3. The portable inflatable apparatus according to claim 1, comprising:

a pressure sensor, in fluid communication with the air pump and an interior of the inflatable structure, configured to detect predetermined inflation and deflation pressures; and the air pump configured to automatically reinflate the inflatable structure when an interior inflatable structure pressure is detected that is below the predetermined inflation pressure.

4. The portable inflatable apparatus according to claim 1, comprising:

the bottom wall formed with a plurality of stand-off stanchions configured to rest against the ground surfaced.

5. The portable inflatable apparatus according to claim 1, comprising:

a plurality of proximity sensors mounted about the base and configured to detect at least one of motion and proximity of an individual during operation.

6. The portable inflatable apparatus according to claim 1, comprising:

a manually actuatable pressurization valve in fluid communication with an interior volume of the inflatable structure, configured to retain and release pressure within and from the interior volume.

7. The portable inflatable apparatus according to claim 1, comprising:

a panel covering one of the at least one openings in the exterior circumference, wherein the opening is formed in the exterior circumference, and the panel mounting an external item inflation port configured to couple to and pressurize an external device.

8. The portable inflatable apparatus according to claim 1, comprising:

a battery mounted in the interior compartment and coupled to the air pump; and at least one of the openings configured to enable replacement of one or more of the air pump, battery, and inflatable structure.

9. The portable inflatable apparatus according to claim 1, comprising:

a battery mounted in the interior compartment and coupled to the air pump; and a power port, coupled to the battery, and mounted about a panel covering one of the at least one openings, the power port configured to supply power from and to charge the battery.

10. The portable inflatable apparatus according to claim 1, comprising:

one or more lights incorporated proximate the top wall and configured to illuminate the inflatable structure.

11. The portable inflatable apparatus according to claim 1, comprising:

a battery mounted in the interior compartment and coupled to the air pump; and one or more lights incorporated with the inflatable structure and configured to be releasably coupled to the battery and to illuminate the inflatable structure.

12. A portable inflatable apparatus, comprising:

a round rigid base configured to have a weight of between 15 and 20 pounds and to rest on a ground surface and formed with a polymeric exterior wall extending between top and bottom walls defining an interior compartment accessible by at least one opening formed in the exterior circumference, the exterior wall formed to be resilient with a hardness between about Shore A 50 and 100 and to extend vertically up from and circumferentially around the bottom wall to have a thickness sized relative to the vertical extent to, in combination with the weight, deflect responsive to impacts from a sports game piece during operation when the bottom wall rests on the ground surface, to rebound the sports game piece;

an air pump coupled to a battery both mounted in the interior compartment;

the base including at least one center of gravity enhancement included as part of the weight and selected from at least one of (a) the bottom wall formed with thickness that is larger than that of the top wall, and (b) a center of gravity plate positioned about an interior side of the bottom wall;

an inflatable monument configured to have a deflated stowed volume less than a portion of the interior compartment, and to be releasably mounted about the base to inflate outwardly from the top wall; and a valve connecting the pump and inflatable monument, the pump and valve configured to pressurize and depressurize the monument.

13. The portable inflatable apparatus according to claim 12, comprising:

a pressure sensor, coupled to the air pump and an interior of the inflatable monument, configured to detect predetermined pressures therein; and the air pump configured to automatically reinflate the inflatable monument when an interior pressure below a predetermined inflation pressure is detected.

14. The portable inflatable apparatus according to claim 12, comprising:

at least one cover configured to close the top wall opening and retain the deflated, stowed monument within the interior compartment, and to isolate the interior compartment from an external environment.

15. The portable inflatable apparatus according to claim 12, comprising:

a pressure sensor, in fluid communication with the air pump and an interior of the inflatable monument, configured to detect predetermined inflation and deflation pressures; and at least one of the air pump and valve actuatable to automatically pressurize and depressurize the monument until the respective inflation and deflation pressures are detected.

16. A portable inflatable apparatus, comprising:

a polymeric base configured to have a weight of between 15 and 20 pounds and to rest on a ground surface and formed with an opening about an exterior circumference extending between top and bottom walls that define an interior compartment, the exterior circumference formed to be resilient with a hardness between about Shore A 50 and 100 and to circumferentially extend upward from the bottom wall to have a thickness relative to the upward extent to, in combination with the weight, deflect responsive to impacts from a sports game piece during operation when the bottom wall rests on the ground surface, to rebound the sports game piece;

a battery powered air pump mounted in the interior compartment;

the base including at least one center of gravity enhancement included as part of the weight and selected from at least one of (a) the bottom wall formed with thickness that is larger than that of the top wall, and (b) a center of gravity plate positioned about an interior side of the bottom wall;

an inflatable structure with tether points releasably retained about the top wall and formed with deflated stowage volume less than a portion of the compartment, and an inflated shape configured to project away from the base when pressurized; and a valve in fluid communication with the pump and inflatable structure, actuatable to release and retain pressure within the structure.

17. The portable inflatable apparatus according to claim 16, comprising:

an external panel incorporated about the exterior circumference and including plurality of controls mounted thereon configured to actuate at least one of the air pump and the valve to inflate and deflate the structure, and to energize lights configured to illuminate the structure.

18. The portable inflatable apparatus according to claim 16, comprising:

at least one cover configured to close the top wall opening and retain the deflated, stowed structure within the interior compartment, and to isolate the interior compartment from an external environment.

* * * * *